US006638334B2

(12) United States Patent
Nakamura et al.

(10) Patent No.: US 6,638,334 B2
(45) Date of Patent: Oct. 28, 2003

(54) SLIDING CONTACT MATERIAL COMPRISING AG-NI BASED ALLOY HAVING NI METAL PARTICLES DISPERSED AND CLAD COMPOSITE MATERIAL, AND DC COMPACT MOTOR USING THE SAME

(75) Inventors: Keiji Nakamura, Chiba-ken (JP); Takemasa Honma, Chiba-ken (JP); Yasuhiro Hashimoto, Chiba-ken (JP); Osamu Sakaguchi, Hiratsuka (JP); Kengo Taneichi, Hiratsuka (JP); Toshiya Yamamoto, Hiratsuka (JP)

(73) Assignees: Mabuchi Motor Co., Ltd. (JP); Tanaka Kikinzoku Kogyo K.K. (JP)

( * ) Notice: Subject to any disclaimer, the term of this patent is extended or adjusted under 35 U.S.C. 154(b) by 0 days.

(21) Appl. No.: 10/088,082

(22) PCT Filed: Jul. 18, 2001

(86) PCT No.: PCT/JP01/06218

§ 371 (c)(1),
(2), (4) Date: Jul. 1, 2002

(87) PCT Pub. No.: WO02/08480

PCT Pub. Date: Jan. 31, 2002

(65) Prior Publication Data

US 2003/0061903 A1 Apr. 3, 2003

(30) Foreign Application Priority Data

Jul. 21, 2000 (JP) ..... 2000-220359

(51) Int. Cl.[7] ..... C22C 1/05; C22C 5/06

(52) U.S. Cl. ..... 75/233; 75/235; 75/247; 428/553; 200/266

(58) Field of Search ..... 75/233, 235, 247; 428/553; 200/266

(56) References Cited

U.S. PATENT DOCUMENTS

| | | | | |
|---|---|---|---|---|
| 4,502,899 A | | 3/1985 | Tsuji et al. | 148/431 |
| 4,808,223 A | * | 2/1989 | Ozaki et al. | 75/235 |
| 5,338,618 A | * | 8/1994 | Suzuki et al. | 428/614 |

FOREIGN PATENT DOCUMENTS

| | | |
|---|---|---|
| JP | A-52-13689 | 2/1977 |
| JP | A-56-81649 | 7/1981 |
| JP | A-58-93849 | 6/1983 |
| JP | A-61-246337 | 11/1986 |
| JP | A-3-71522 | 3/1991 |

* cited by examiner

*Primary Examiner*—Ngoclan Mai
(74) *Attorney, Agent, or Firm*—Rothwell, Figg, Ernst & Manbeck

(57) ABSTRACT

The present invention is aimed at providing a sliding contact material that has an alloy composition containing no harmful substance like Cd, especially excellent contact resistance properties, electrical functions that are good and is not subject to secular change, and abrasion resistance practically bearing comparison with conventional sliding contact materials, and is aimed at lengthening the life of a motor by the use of a sliding contact material having excellent durability as a commutator for a small direct-current motor. The present invention is a sliding contact material of an Ag—Ni-based alloy that is used in sliding part electrically switching on and off by mechanical sliding action, and the material is a sliding contact material of Ni metal particle-dispersed-type Ag—Ni-based alloy that is produced in such a method that 0.7 to 3.0 wt. % Ni powder, an additive of $Li_2CO_3$ powder corresponding to 0.01 to 0.50 wt. % Li after being converted to metal and the balance of Ag powder are mixed and stirred to form a uniformly dispersed mixture, then the mixture is treated with forming and sintering processes.

20 Claims, 4 Drawing Sheets

SLIDING CONTACT MATERIAL COMPRISING AG-NI BASED ALLOY HAVING NI METAL PARTICLES DISPERSED AND CLAD COMPOSITE MATERIAL, AND DC COMPACT MOTOR USING THE SAME

TECHNICAL FIELD

The present invention relates to a sliding contact material that is used in a sliding part electrically switching on and off by a mechanical sliding action, particularly to a sliding contact material that is used in a commutator for a small direct-current motor which is used for loading of taking a CD in and out in a CD player or used for sending a pick to move a lens for reading signals of a CD, and further used in a commutator for a small direct-current motor which is used in household electrical appliances that are driven with a rechargeable battery (and others, including an earth ring and a rotary switch).

BACKGROUND ART

Recently, in the technical field mentioned above, studies have been energetically carried out to develop new sliding contact materials. Concerning these sliding contact materials, it may be stated that the most important subject to be developed is to make abrasion ideal when the contact is used and to realize low contact resistance. Originally, realizing the low contact resistance of a sliding contact material can be attained by surely contacting or adhering both materials to be contacted each other, as well as their conductivities. However, when the material slides, the higher the degree of the contact or adhesion of both materials to be contacted is, the larger the frictional resistance becomes, and sliding the materials against the friction produces remarkable abrasion phenomena. That is, in a sliding contact material, it is difficult to obtain more ideal properties unless the above-mentioned phenomena that are contrary to each other are controlled. Further, there are many scientifically unsolved points in the abrasion phenomena of this sliding contact, and it is also stated that controlling the abrasion phenomena by improving a sliding contact material is very difficult.

The abrasion in sliding contact materials is divided broadly into cohesion abrasion and scratch abrasion. Generally, even if the surface of a sliding contact material is finished to be considerably smooth, it is not a complete plane surface from the microstructural point of view and there are many micro uneven parts. When such metal surfaces are made contacted each other, though it seems that they are apparently contacted over the wide range of areas, they are practically in the state that projected sections out of the micro uneven parts existing in the surfaces are contacted, so that the true contact area is smaller than the apparent one. Consequently, high pressure will be applied on this true contact area, i.e., the projected sections that are contacted, to generate the deposition of contacted metals. As a result, cohesion abrasion is produced by which the soft metal is torn off and moved to the hard metal. Further, in the case where materials of different hardness are contacted, or in the case where hard particles are contained in one side even when soft metals are contacted, the soft metal is mechanically sheared by the hard metal to produce scratch abrasion.

Such abrasion phenomena depend heavily on the hardness of each metal material to be contacted, the bonding abilities of those metals and others, and abrasion phenomena of sliding contact materials also become remarkable basically in proportion to the contact pressure, so the abrasion phenomena can be reduced by the hardening of materials. However, abrasion phenomena also greatly change according to the change of temperature and humidity and the existence of any corrosive component, organic vapor, dust and the like when the materials are contacted. And since this change of abrasion phenomena is the change of the contacting states at the contact part, it will cause increasing in contact resistance to affect greatly the stable maintenance of contact resistance.

Abrasion phenomena mentioned above are concretely induced between a commutator and a brush when a cladding composite material using a sliding contact material is built into a small direct-current motor as a commutator and the motor is driven at high speed rotation. That is, the sliding contact material constituting the commutator is subjected to contact friction for a long stretch of time and frictional heat is also added, resulting in inducing cohesion abrasion and scratch abrasion as mentioned above in the combined state. Consequently, the surface of the sliding contact material is shaved by the abrasion phenomena to produce abrasion powder, which powder causes to increase contact resistance, make conduction short by filling up gaps between commutators with the abrasion powder or be attributable to generate noise.

Moreover, if the abrasion phenomena proceed further, in a cladding composite material using a sliding contact material, the metal, i.e., the sliding contact material that is provided on the surface layer of the cladding composite material is broken by abrasion and the abrasion will reach to the base material under the composite material. When such an abrasion state is made, because the base material, which is easily oxidized, is exposed, all sorts of electrical troubles may be caused by the metal oxide of the base material. Accordingly, when a so-called two-layer or three-layer cladding composite material is constituted and used as a commutator, it is an extremely important subject to improve an alloy material composing each layer.

Now, in recent years, as a sliding contact material that is used in a commutator for a small direct-current motor which is used for loading of taking a CD in and out in a CD player or used for sending a pick to move a lens for reading signals of a CD, and a sliding contact material that is further used in a commutator for a small direct-current motor which is used in household electrical appliances that are driven with a rechargeable battery, a two layer cladding composite material in which a Ag—Cd alloy containing 1 to 2 wt. % Cd and the balance of Ag is used in the surface layer, and Cu or a Cu alloy is used in the base layer (e.g., Ag 99-Cd 1/Cu), a two-layer cladding composite material in which a Ag—Cd—Ni alloy containing 1 to 2 wt. % Cd, 0.01 to 0.70 wt. % Ni and the balance of Ag is used in the surface layer, and Cu or a Cu alloy is used in the base layer (e.g., Ag 97.7-Cd 2-Ni 0.3/Cu) and others are used. The "alloy composition/Cu" described in the parentheses mentioned above means a cladding composite material constituting two layers and the "/" means the interface between the surface layer and the base layer. Further, the numerals described after the elements of alloy compositions mean the values in weight percent.

Such Ag—Cd alloy and Ag—Cd—Ni alloy are materials that are very excellent in electrical functions, hardness and low contact resistance properties, and are disclosed in, for example, Japanese Patent Publication No. Hei 2-60745 as a sliding contact material comprising a Ag alloy that contains at least one of Sn and Cd in 1 to 5 wt. % and the balance of Ag for a commutator in a small direct-current motor.

However, considering environmental problems in these days, it is not desirable to produce and use sliding contact materials containing Cd that is considered to be a harmful substance.

As other typical alloys, Ag—Cu alloys, Ag—Cu—Cd alloys are also used. However, these sliding contact materials have low contact resistance at the initial stage of their usage, but the contact resistance is subject to secular change. Consequently, they have such a problem that the worth of a product using a rechargeable battery, including a shaver, is inferior. That is, in the case where a sliding contact material of these alloys is used in a motor, because the contact resistance becomes high with the passage of time, the starting voltage of the motor becomes high to lower the electromotive force of the battery, which cause a problem that the motor is not started up. As a result, the frequency of charging the battery is also increased and the battery itself shows a tendency of shortening its life.

Further, for example, in Japanese Patent Application Laid-open No. Sho 58-104140, a sliding contact material of Ag—Zn-based alloys is disclosed in which 1 to 10 wt. % Zn and 0.5 to 1.0 wt. % at least one metal selected from the group of Te, Co, Ni, Cu, Ge, Ti and Pb are added in Ag. This sliding contact material contains Te, Co, Ni, Cu, Ge, Ti and Pb in order to retard the oxidation of Zn, maintain the sulfuration resistance and lubricity of the sliding contact material, improve the abrasion resistance and stabilize the low contact resistance because of the characteristics that these metals are oxidized more easily than Zn. However, this sliding contact material also has low contact resistance at the initial stage similarly to Ag—Cu alloy and the like, but the contact resistance changes with the passage of time and becomes high as the period of its usage is prolonged.

Moreover, in Japanese published unexamined application 8-260078, sliding contact materials of Ag—Zn alloys and Ag—Zn—Ni alloys are disclosed. These materials also have low contact resistance, but do not gain a sliding contact material in which abrasion phenomena are controlled to such a degree as to improve the life of a motor.

As mentioned above, it is difficult to say that conventional sliding contact materials can correspond sufficiently to the specifications of loading and those of sending a pick in recent downsized CD players. With a CD player is downsized, a motor used in the inside of the player is also downsized, but the specifications themselves of loading in the CD player need the same torque as that needed conventionally without reference to the size of a motor. From that reason, even if a motor is downsized, a downsized motor having necessary torque is realized by operating the motor at high velocity revolution of 10,000 rpm or more and through a gear. However, because the properties of conventional sliding contact material are insufficient in the area of this high velocity revolution of 10,000 rpm or more, a more durable sliding contact material is strongly needed.

DISCLOSURE OF THE INVENTION

Accordingly, the present invention is aimed at providing a sliding contact material that has an alloy composition containing no harmful substance like Cd, especially excellent contact resistance properties, electrical functions that are good and is not subject to secular change, and abrasion resistance practically bearing comparison with conventional sliding contact materials, and further aimed at lengthening the life of a motor by the use of a sliding contact material having such excellent properties as a commutator for a small direct-current motor.

The present inventors have devoted themselves to the study and found that the above-mentioned subjects would be solved by the usage of a sliding contact material, of Ni metal particle-dispersed-type Ag—Ni-based alloy produced in such a method that 0. 7 to 3.0 wt. % Ni powder, an additive of $Li_2CO_3$ powder corresponding to 0.01 to 0.50 wt. % Li after being converted to metal and the balance of Ag powder were mixed and stirred to form a uniformly dispersed mixture, then the mixture was formed and sintered.

The sliding contact material of Ni metal particle-dispersed-type Ag—Ni-based alloy of the present invention is an alloy of Ag—Ni series in which Ni particles are dispersed in a Ag matrix and $Li_2CO_3$ is moderately dispersed in the alloy. $Li_2CO_3$ dispersed in this material forms $LiOH.H_2O$ on the surface of the material during its sliding and the formed $LiOH.H_2O$ becomes a coating and serves as a lubricant on the sliding part to lower the frictional resistance of the material. As a result, the abrasion resistance of the material is improved.

Conventional sliding contact materials, for example, Ag—Zn alloys, Ag—Cu alloys and the like are also aimed at controlling abrasion phenomena by forming oxide bands of ZnO and CuO, but these alloys produce ZnO and CuO in surplus at the contact part with the passage of time when they are let alone in the air, resulting in increasing the contact resistance of the material conversely. In particular, when CuO having low electric conductivity is produced in surplus, the contact resistance is remarkably increased. Even in case of ZnO that is electrically conductive, its excessive production will increase the contact resistance.

On the other hand, in the sliding contact material of the present invention, Ni metal particles in Ag matrix slightly form NiO on the polar surface, but NiO does not cover all the surface of the contact because Ni exists as metal particles in the material. In addition, since $Li_2Co_3$ dispersing in the material is small in quantity as it is converted to 0.01 to 0.50 wt. % Li metal, it does not have as much influences as to increase the contact resistance.

Moreover, since the sliding contact material of Ni metal particle-dispersed-type Ag—Ni-based alloy of the present invention is also produced by the so-called powder metallurgy method, Ni metal particles and $Li_2CO_3$, which exist in Ag matrix, are dispersed with extreme uniformity. In the dissolution method, however, Ag—Ni series alloys having the same compositions as those in the present invention cannot be formed. From that reason, in the present invention, the improvement of the stability of the contact resistance and the abrasion resistance, which could not be made by sliding contact materials of conventional Ag—Zn—Pd—Cu—Ni alloys and the like, can be achieved at the same time without containing Cd.

Ni metal particles in this sliding contact material of Ni metal particle-dispersed-type Ag—Ni-based alloy of the present invention mainly performs a role of improving the abrasion resistance of the sliding contact material. If the amount of Ni is less than 0.7 wt. % when mixed as Ni powder, the effect of improving the abrasion resistance with Ni metal particles tends to decrease, and if the amount is over 3.0 wt. %, the abrasion resistance will be excessively improved to wear the brush, resulting in the shortening of the durable life of the motor. Mixing Ni powder in 0.7 to 2.0 wt. % will be able to make the properties of the sliding contact material of Ni metal particle-dispersed-type Ag—Ni-based alloy related to the present invention most excellent.

In the sliding contact material of Ni metal particle-dispersed-type Ag—Ni-based alloy of the present invention, the amount of Ni contained in the material is 0.7 to 3.0 wt. %. In the case where such sliding contact material of Ni metal particle-dispersed-type Ag—Ni-based alloy is daringly formed by fusion casting, because Ag and Ni are hardly dissolved each other when they are fused, they are separated in two phases and exist separately in the fused state respectively so that Ni is upper side and Ag is lower side in a crucible. Accordingly, even if they are cast, only such a Ag—Ni alloy as Ni is segregated can be obtained. That is, the sliding contact material of Ni metal particle-dispersed-type Ag—Ni-based alloy of the present invention cannot be formed by the dissolution method. Thus, since the sliding contact material of an alloy of Ag—Ni series of the present invention is formed by the powder metallurgy method, Ni particles in the material become to be in the state of dispersed with extreme uniformity in Ag matrix and function sufficiently to improve the abrasion resistance.

Further, $Li_2CO_3$ that is dispersed in the sliding contact material of Ni metal particle-dispersed-type Ag—Ni-based alloy of the present invention becomes to be $LiOH.H_2O$ at the sliding part, that is, the contact surface and works as a lubricant. If the amount of the dispersed $Li_2CO_3$ is less than 0.01 wt. % Li after being converted to metal, it tends to decrease in exerting the function as a lubricant, and if the amount is over 0.5 wt. %, the stability of the contact resistance of the sliding contact material tends to lower as well as the lowering of its processability. About $Li_2CO_3$, mixing $Li_2CO_3$ powder in the rate of 0.05 to 0.20 wt. % Li after being converted to metal will be able to make the properties of the sliding contact material of Ni metal particle-dispersed-type Ag—Ni-based alloy related to the present invention most excellent.

The present inventors have performed all sorts of studies on additives for the sliding contact material of Ni metal particle-dispersed-type Ag—Ni-based alloy and found that the subjects of the present invention could be achieved by adding $La_2O_3$ in addition to $Li_2CO_3$. To be concrete, it is a sliding contact material of Ni metal particle-dispersed-type Ag—Ni-based alloy produced in such a method that 0.7 to 3.0 wt. % Ni powder, additives of $Li_2CO_3$ powder corresponding to 0.01 to 0.50 wt. % Li after being converted to metal and $La_2O_3$ powder corresponding to 0.01 to 1.00 wt. % La after being converted to metal, and the balance of Ag powder were mixed and stirred to form a uniformly dispersed mixture, then the mixture was formed and sintered.

This $La_2O_3$ disperses in the material similarly to $Li_2CO_3$, and $La_2O_3$ particles themselves work as lubricant and further exist in not only Ag matrix but also the inside of Ni metal particles to contribute to improve the abrasion resistance of the material together with the synergistic effect of improving the abrasion resistance of Ni metal particles. If the amount of the dispersed $La_2O_3$ is less than 0.01 wt. % La after being converted to metal, it cannot obtain the synergistic effect with Ni metal particles, and if the amount is over 1.00 wt. %, the stability of the contact resistance of the sliding contact material tends to lower as well as the lowering of its proccessability. About $La_2O_3$, mixing $La_2O_3$ powder in the rate of 0.20 to 0.40 wt. % La after being converted to metal will be able to make the properties of the sliding contact material of Ni metal particle-dispersed-type Ag—Ni-based alloy related to the present invention most excellent.

Other oxides of rare earth elements, for example, $Ce_2O_3$, $Sm_2O_3$ and the like can be substituted for $La_2O_3$ in the sliding contact material of Ni metal particle-dispersed-type Ag—Ni-based alloy of the present invention. The reason why $La_2O_3$ is adopted in the sliding contact material of Ni metal particle-dispersed-type Ag—Ni-based alloy of the present invention is that $La_2O_3$ is resourceful and easily available.

In the case where the sliding contact material of Ni metal particle-dispersed-type Ag—Ni-based alloy of the present invention is used as a commutator in a motor, in order to make more suitable material for a commutator, it is preferable to use Cu or a Cu alloy as a base material and to make a cladding composite material in which the sliding contact material of the present invention is buried under a part of the base material. In this manner, better soldering can be achieved in soldering treatment needed to electrically connect a commutator and processability of the material for forming it in a commutator shape is also improved. Moreover, because the thickness of the sliding contact material of the present invention, which material is buried under the base material in accordance with a motor to be used, can be controlled by adopting a form of a cladding composite material, an expensive sliding contact material can be restricted to use partly, leading to an economically favorable result.

In case of a cladding composite material as mentioned above, part of the buried sliding contact material which is bared to the surface is easily corroded because of being exposed to the air. Accordingly, in a cladding composite material in which the sliding contact material of the present invention is buried under the part of the base material of Cu or a Cu alloy, it is preferable to coat at least part of the surface of the sliding contact material with Au or a Au alloy. Though Au or a Au alloy is known to be excellent in corrosion resistance and to be a good material for a sliding contact material to realize low contact resistance, it is economically disadvantageous to use them in large quantities because of its expensiveness. Accordingly, it is intended to retard the increase in the cost by coating a part with Au or a Au alloy and further to prevent the corrosion in the sliding contact material of Ni metal particle-dispersed-type Ag—Ni-based alloy related to the present invention. If a cladding composite material like this is used for a commutator of a motor, good driving of the motor becomes possible because of the excellent contact resistance property of Au or a Au alloy at the initial stage of its usage, and even if Au or a Au alloy is broken down due to abrasion, because the sliding contact material of the present invention exists in the inner part, it is possible to further use the motor continuously.

Moreover, if a so-called two-layer or three-layer cladding composite material of the present invention as mentioned above is used in a small direct-current motor as a commutator, the low contact resistance can be stably realized, the change with the passage of time is small, and there is no trouble due to abrasion powder, consequently the small direct-current motor can be driven with low starting voltage. Hereby, when the cladding composite material is used for loading or sending a pick in a CD player, the life of the small direct-current motor itself can be prolonged.

BEST MODE FOR CARRYING OUT THE INVENTION

Figure 1:
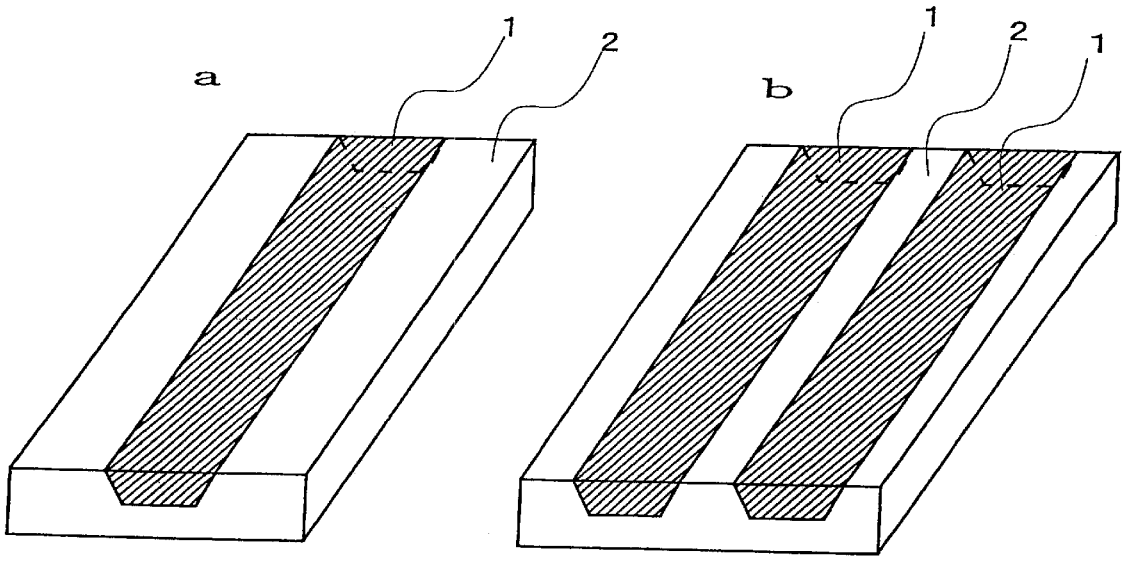
FIG. 1 shows a perspective view of a two-layer cladding composite material.

One embodiment of the present invention will be explained based on examples described in the following. Table 1 shows the compositions of sliding contact materials in Examples 1 and 2. Table 2 shows compositions of sliding contact materials in Conventional example 1 and Comparative example 1 that their properties were compared. Further, the sliding contact material in Comparative example 1 is one that the present inventors developed before.

TABLE 1

| | Ag powder (wt. %) | Ni powder (wt. %) | $Li_2CO_3$ powder (converted to Li metal, wt. %) | $La_2O_3$ powder (converted to La metal, wt. %). |
|---|---|---|---|---|
| Example 1 | The balance | 1.0 | 0.1 | — |
| Example 2 | The balance | 1.0 | 0.1 | 0.3 |

TABLE 2

| | Ag | Cd | Pd | Cu | Zn | Ni |
|---|---|---|---|---|---|---|
| Conventional example 1 | The balance | 2.0 | — | — | — | 0.3 |
| Comparative example 1 | The balance | — | 0.5 | 0.5 | 0.5 | 0.3 |

(Wt. %)

In a sliding contact material of Ni metal particle-dispersed-type Ag—Ni-based alloy in Example 1, first, 1.0 wt. % Ni powder, $Li_2CO_3$ powder corresponding to 0.1 wt. % Li after being converted to metal and the balance of Ag powder were stirred in a ball mill for 4 hours to make a powder mixture in which each powder was dispersed uniformly. Then, the powder mixture was filled into a cylindrical vessel and was subjected to the forming by compression treatment in which pressure of $4.9\times10^5$ N (50 t f) was added from the longitudinal direction of the column to form a cylindrical billet of 50 mm in diameter. Subsequently, the cylindrical billet was sintered at a temperature of 1123 K (850° C.) for 4 hours. The forming by compression treatment and the sintering treatment were repeated four times.

The cylindrical billet, which had been subjected to the forming by compression and the sinter treatment, was formed. to a wire rod of 6.0 mm in diameter by hot extruding. Continuously, the rod was formed to a wire rod of 1.6 mm in diameter by the wire drawing process.

In a sliding contact material of Ni metal particle-dispersed-type Ag—Ni-based alloy in Example 2, first, 1.0 wt. % Ni powder, $Li_2CO_3$ powder corresponding to 0.1 wt. % Li after being converted to metal, $La_2O_3$ powder corresponding to 0.3 wt. % La after being converted to metal and the balance of Ag powder were stirred in a ball mill for 4 hours to make a powder mixture in which each powder was dispersed uniformly. Then, the powder mixture was filled into a cylindrical vessel and was subjected to the forming by compression treatment in which pressure of $_{4.9\times10}{}^5$ N (50 t f) was added from the longitudinal direction of the column to form a cylindrical billet of 50 mm in diameter. The following processes will be omitted because they are the same as those in Example 1.

Conventional example 1 and Comparative example 1 relate to sliding contact materials obtained by the dissolution method. In the method, each metal was dissolved so that each composition shown in Table 2 would be obtained. Then, casting, extruding and wire drawing were carried out to form a wire rod of 1.6 mm in diameter.

Each wire rod formed as mentioned above was processed to a tape in shape with a rolling machine. Then, the tape was inlaid and joined in Cu material as a base material to prepare a cladding composite material. This cladding composite material was heat-treated at 1023 K (750° C.) and repeatedly rolled to make a two-layer cladding composite material of 0.2 mm in total thickness and 19 mm in width.

Figure 2:
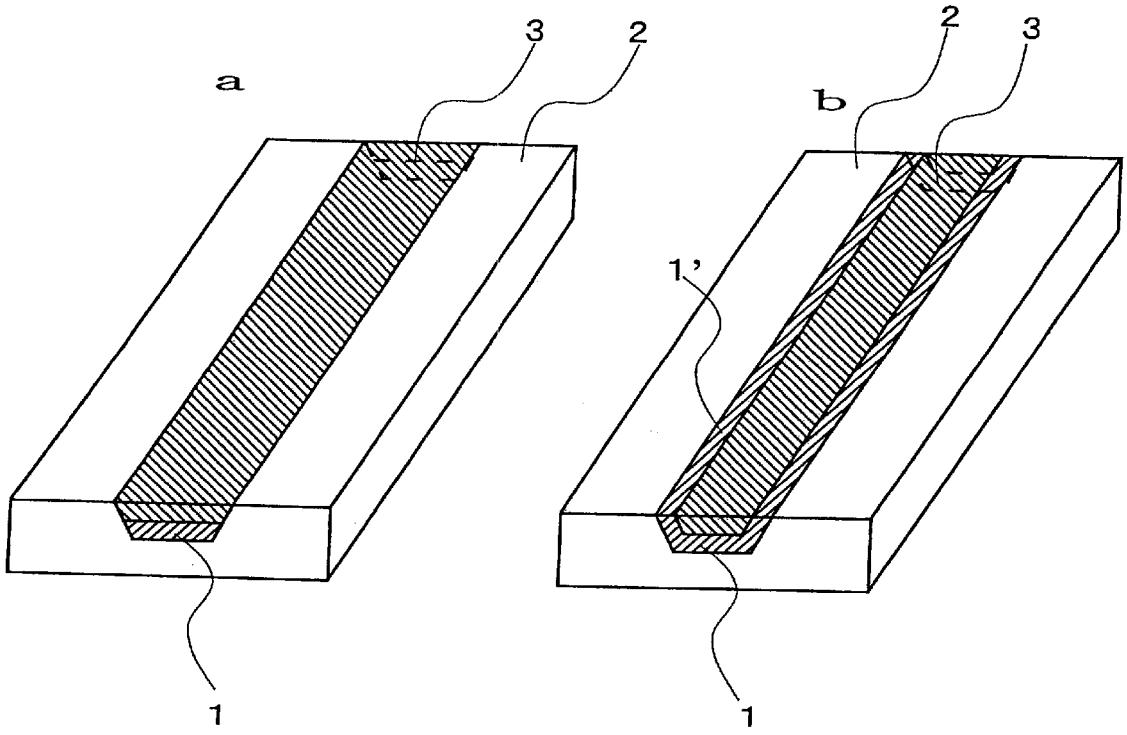
FIG. 2 shows a perspective view of a three-layer cladding composite material.

Next, one embodiment of a cladding composite material related to the present invention is explained. Perspective views in FIG. 1 show so-called two-layer cladding composite materials in which a sliding contact material shown in this embodiment is buried in part of a base material comprising of a Cu alloy. And, perspective views in FIG. 2 show so-called three-layer cladding composite materials in which a sliding contact material shown in this embodiment is buried in part of a base material comprising of a Cu alloy and further part of the buried sliding contact material is coated with Au or a Au alloy. FIG. 1*a* and FIGS. 2*a* and 2*b* show cladding composite materials covered with a single line of the sliding contact material and FIG. 1*b* shows a cladding composite material covered with two lines of the sliding contact material. In the figures, symbol 1 indicates the sliding contact material of the present invention, symbol 1' in FIG. 2 indicates the exposed part showing partly exposed part of the buried sliding contact material, symbol 2 indicates abase material comprising of a Cu alloy, and symbol 3 indicates Au or a Au alloy.

Furthermore, a small direct-current motor was actually assembled with the cladding material mentioned above and the durability of the motor was examined. The examined results will be explained in the next place. Building in the small direct-current motor was carried out in such a method that a two-layer cladding composite material as shown in the above-mentioned FIG. 1*a* was prepared using the sliding contact material of each composition shown in Table 1 and Table 2 and then the two-layer cladding composite material was processed to make a triode commutator. Conditions of the endurance test are as shown in the following Table 3.

TABLE 3

| | |
|---|---|
| Temperature | 295 K (22° C.) |
| Humidity | 50% |
| Voltage | 6.5 V |
| Electric current | 250 mA |
| Mode | Normal revolution (clockwise seen from the output side) 2 seconds-stop 1 second-inverse revolution (counterclockwise seen from the output side) 2 seconds-stop 1 second |
| Number of rotations | 12000 rpm |
| Torque | $784 \times 10^{-4}$ N − m (8 gf-cm) |
| The number of tested motors | 5 motors |

Figure 3:
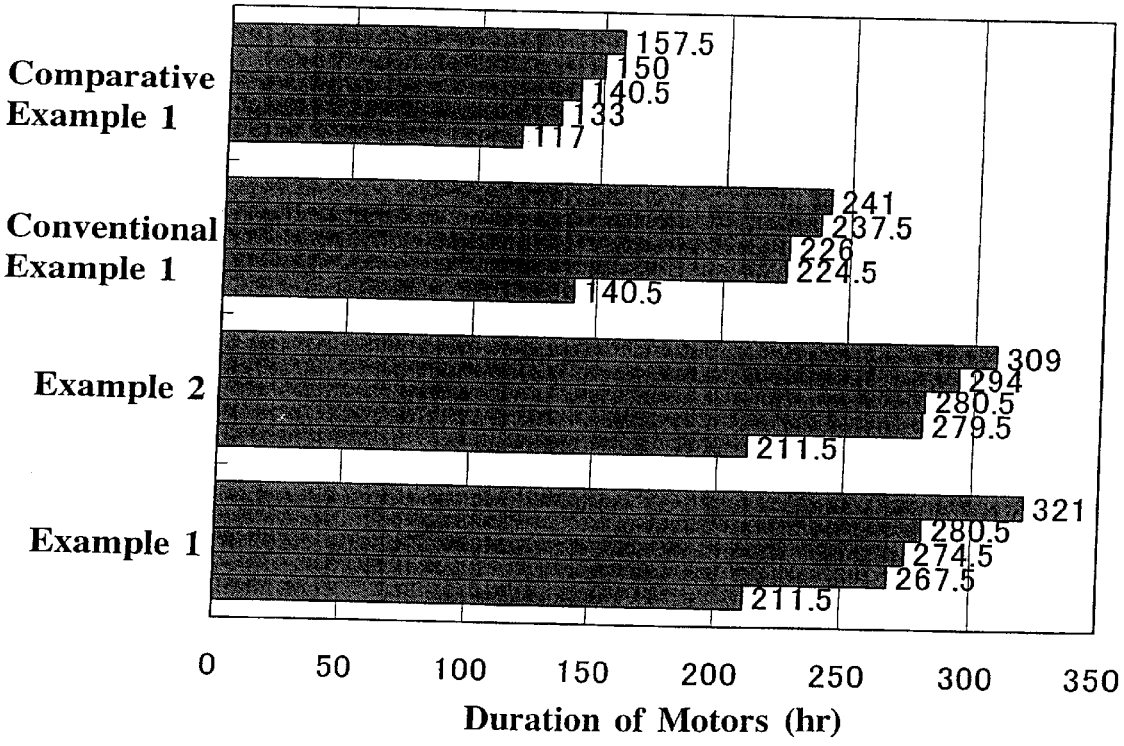
FIG. 3 shows bar graphs indicating the results of endurance tests.

Endurance time values until tested motors failed in each example are shown in Table 4, which value was obtained from the above-mentioned endurance test, and the data are shown by bar graphs in FIG. 3.

TABLE 4

| | Each time when each of tested 5 motors stopped in the endurance test (hr) | | | | |
|---|---|---|---|---|---|
| Example 1 | 221.5 | 267.5 | 274.5 | 280.5 | 321.0 |
| Example 2 | 211.5 | 279.5 | 280.5 | 294.0 | 309.0 |

TABLE 4-continued

| | Each time when each of tested 5 motors stopped in the endurance test (hr) | | | | |
|---|---|---|---|---|---|
| Conventional example 1 | 140.5 | 224.5 | 226.0 | 237.5 | 241.0 |
| Comparative example 1 | 117.0 | 133.0 | 140.5 | 150.0 | 157.5 |

As shown in Table 4 and FIG. 3, motors using sliding contact materials of Ni metal particle-dispersed-type Ag—Ni-based alloy in Examples 1 and 2 showed more excellent durability than that in motors using the sliding contact material containing Cd in Conventional example 1. In the high-speed rotation conditions in the present endurance test of 250 mA in electric current and 12000 rpm in rotation, the sliding contact material in Comparative example 1 tends to provide deteriorated durability, but it was confirmed that motors become to have sufficiently practical durable lives in Examples 1 and 2.

Figure 4:
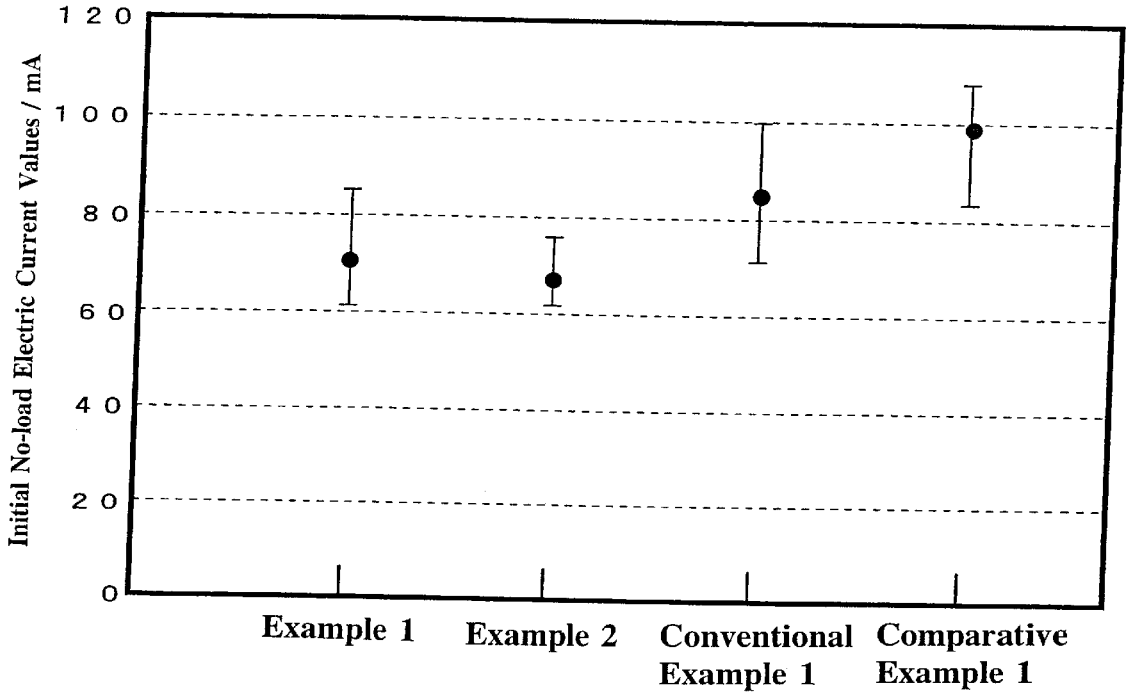
FIG. 4 shows a graph indicating measured results of initial no-load electric current values.

Subsequently, the measurement results of initial no-load electric current values (the value means electric current when a new motor starts to rotate in the state of no-load and 6 V in voltage) is explained. The results of the measured values are shown in Table 5, and the graphic data are shown in FIG. 4.

TABLE 5

| | The minimum value | The maximum value | The average value |
|---|---|---|---|
| Example 1 | 61.3 | 85.1 | 71.3 |
| Example 2 | 62.5 | 75.2 | 67.6 |
| Conventional example 1 | 71.1 | 99.8 | 84.6 |
| Comparative example 1 | 84.7 | 107.0 | 98.1 |

(mA)

As shown in Table 5 and FIG. 4, it was confirmed that the initial no-load electric current values of motors using the sliding contact materials of Ni metal particle-dispersed-type Ag—Ni-based alloy in Examples 1 and 2 are clearly lower than those of motors using the sliding contact material containing Cd in Conventional example 1 and motors using the sliding contact material in Comparative example 1 that was developed by the present inventors before.

When the test results explained above are summarized, it has been proved that the sliding contact materials of Ni metal particle-dispersed-type Ag—Ni-based alloy of the present invention have durability equal to or higher than conventional sliding contact materials containing Cd even in such use conditions as an electric current value of 250 mA and a rotation number of 12000 rpm. Further, it has been proved that the sliding contact materials of Ni metal particle-dispersed-type Ag—Ni-based alloy of the present invention have higher capability of lowering the initial no-load electric current value when compared to conventional sliding contact materials containing Cd.

Industrial Applicability

The sliding contact materials of Ni metal particle-dispersed-type Ag—Ni-based alloy of the present invention have alloy compositions containing no harmful substance like Cd, electrical functions that are good and is not subject to secular change, and abrasion resistance practically bearing comparison with conventional moving contact materials. When the sliding contact material of Ni metal particle-dispersed-type Ag—Ni-based alloy of the present invention is applied to a household electric appliance provided with a small direct-current motor using a rechargeable battery, since the motor maintains low contact resistance with time and can be driven with low starting voltage, the motor can be continuously used for such a long period of time as being unrealizable so far and further the life of the rechargeable battery used for driving the motor can also be prolonged.

What is claimed is:

1. A sliding contact material comprising an Ag—Ni-based alloy in which Ni metal particles are dispersed throughout the alloy, wherein the material is produced by the method comprising the steps of:

(a) providing Ni powder that corresponds to 0.7 to 3.0 wt. % of the final material, Li that corresponds to 0.01 to 0.5 wt. % of the final material, wherein said Li is in the form of $Li_2CO_3$ powder, and Ag powder, said Ag powder being substantially the remainder of the sliding contact material;

(b) mixing and stirring the Ni powder, $Li_2CO_3$ powder, and Ag powder to form a uniformly dispersed mixture; and thereafter (c) forming and sintering the mixture to obtain an Ag—Ni based alloy in which the Ni metal particles are dispersed throughout the alloy.

2. A sliding contact material comprising an Ag—Ni-based alloy in which Ni metal particles are dispersed throughout the alloy, wherein the material is produced by the method comprising the steps of:

(a) providing Ni powder that corresponds to 0.7 to 3.0 wt. % of the final material, Li that corresponds to 0.01 to 0.50 wt. % of the final material, wherein said Li is in the form of $Li_2CO_3$ powder, La that corresponds to 0.01 to 0.50 wt. % of the final material, wherein said La is in the form of $La_2O_3$ powder, and Ag powder, said Ag powder being substantially the remainder of the sliding contact material;

(b) mixing and stirring the Ni powder, $Li_2CO_3$ powder, $La_2O_3$ powder, and Ag powder to form a uniformly dispersed mixture; and thereafter (c) forming and sintering the mixture to obtain an Ag—Ni based alloy in which the Ni metal particles are dispersed throughout the alloy.

3. A cladding composite material, wherein the sliding contact material according to claim 1, an Ag—Ni-based alloy in which Ni metal articles are dispersed throughout the alloy, is buried on part of base material made of Cu or Cu alloy.

4. A cladding composite material in which the sliding contact material according to claim 1, of an Ag—Ni-based alloy in which Ni metal particles are dispersed throughout the alloy, is buried on part of base material made of Cu or Cu alloy, wherein at least part of the buried sliding contact material of an Ag—Ni based alloy in which Ni metal particles are dispersed throughout the alloy, is coated with Au or a Au alloy.

5. A small direct-current motor, wherein the cladding composite material according to claim 3 is used as a commutator.

6. A cladding composite material according to claim 2, wherein the sliding contact material of an Ag—Ni-based alloy in which Ni metal particles are dispersed throughout the alloy, is buried on part of base material made of Cu or Cu alloy.

7. A cladding composite material according to claim 2, in which the sliding contact material of an Ag—Ni-based alloy in which Ni metal particles are dispersed throughout the alloy, is buried on part of base material made of Cu or Cu alloy, wherein at least part of the buried sliding contact material of an Ag—Ni-based alloy in which Ni metal particles are dispersed throughout the alloy, is coated with Au or a Au alloy.

8. A small direct-current motor, wherein the cladding composite material according to claim 4 is used as a commutator.

9. A small direct-current motor, wherein the cladding composite material according to claim 6 is used as a commutator.

10. A small direct-current motor, wherein the cladding composite material according to claim 7 is used as a commutator.

11. A sliding contact material comprising an Ag alloy in which Ni metal particles and $Li_2CO_3$ powder particles are dispersed throughout the alloy, wherein the material is produced by the method comprising the steps of:

(a) providing Ni powder that corresponds to 0.7 to 3.0 wt. %, $Li_2CO_3$ powder that corresponds to 0.053 to 2.662 wt. %, and Ag powder, said Ag powder being substantially the remainder of the sliding contact material;

(b) mixing and stirring the Ni powder, $Li_2CO_3$ powder, and Ag powder to form a uniformly dispersed mixture; and thereafter (c) forming and sintering the mixture to obtain an Ag alloy in which Ni metal particles and $Li_2CO_3$ powder particles are dispersed throughout the alloy.

12. A sliding contact material comprising an Ag alloy in which Ni metal particles, $Li_2CO_3$ powder particles and $La_2O_3$ powder particles are dispersed throughout the alloy, wherein the material is produced by the method comprising the steps of:

(a) providing Ni powder that corresponds to 0.7 to 3.0 wt. % of the final material, $Li_2CO_3$ powder that corresponds to 0.053 to 2.662 wt. %, $La_2O_3$ powder that corresponds to 0.012 to 1.173 wt. % and Ag powder, said Ag powder being substantially the remainder of the sliding contact material;

(b) mixing and stirring the Ni powder, $Li_2CO_3$ powder, $La_2O_3$ powder, and Ag powder to form a uniformly dispersed mixture; and thereafter (c) forming and sintering the mixture to obtain Ag alloy in which Ni metal particles, $Li_2CO_3$ powder particles and $La_2O_3$ powder particles are dispersed throughout the alloy.

13. A cladding composite material according to claim 6, wherein the sliding contact material of an Ag alloy in which Ni metal particles, $Li_2CO_3$ powder particles are dispersed throughout the alloy, is buried on part of base material made of Cu or Cu alloy.

14. A cladding composite material according to claim 7, wherein the sliding contact material of an Ag alloy in which Ni metal particles, $Li_2CO_3$ powder particles and $La_2O_3$ powder particles are dispersed throughout the alloy, is buried on part of base material made of Cu or Cu alloy.

15. A cladding composite material according to claim 6, in which the sliding contact material of an Ag alloy in which Ni metal particles, $Li_2CO_3$ powder particles are dispersed throughout the alloy, is buried on part of base material made of Cu or Cu alloy, wherein at least part of the buried sliding contact material of an Ag alloy in which Ni metal particles $Li_2CO_3$ powder particles are dispersed throughout the alloy, is coated with Au or a Au alloy.

16. A cladding composite material according to claim 7, in which the sliding contact material of an Ag alloy in which Ni metal particles, $Li_2CO_3$ powder particles and $La_2O_3$ powder particles are dispersed throughout the alloy, is buried on part of base material made of Cu or Cu alloy, wherein at least part of the buried sliding contact material of an Ag alloy in which Ni metal particles $Li_2CO_3$ powder particles and $La_2O_3$ powder particles are dispersed throughout the alloy, is coated with Au or a Au alloy.

17. A small direct-current motor, wherein the cladding composite material according to claim 13 is used as a commutator.

18. A small direct-current motor, wherein the cladding composite material according to claim 14 is used as a commutator.

19. A small direct-current motor, wherein the cladding composite material according to claim 15 is used as a commutator.

20. A small direct-current motor, wherein the cladding composite material according to claim 18 is used as a commutator.

* * * * *